United States Patent [19]

Yan

[11] 4,350,391

[45] Sep. 21, 1982

[54] IN SITU LEACHING PROCESS

[75] Inventor: Tsoung-Yuan Yan, Philadelphia, Pa.

[73] Assignee: Mobil Oil Company, New York, N.Y.

[21] Appl. No.: 179,560

[22] Filed: Aug. 19, 1980

[51] Int. Cl.[3] ..... E21B 43/28; E21C 41/14

[52] U.S. Cl. ..... 299/4

[58] Field of Search ..... 299/4, 5; 166/307, 271

[56] References Cited

U.S. PATENT DOCUMENTS

| | | | |
|---|---|---|---|
| 3,574,599 | 4/1971 | Ortloff et al. | 299/4 |
| 4,185,872 | 1/1980 | Habib, Jr. | 299/4 |
| 4,258,954 | 3/1981 | Stover | 299/4 |

*Primary Examiner*—Stephen J. Novosad

*Attorney, Agent, or Firm*—Charles A. Huggett; Michael G. Gilman; John K. AboKhair

[57] ABSTRACT

A process is described for maintaining a relatively high and constant concentration in the leachate of an in situ leaching operation as the mineral value in the formation is depleted, and without reducing the daily production, by adjusting the pumping rate of lixiviant proportionally to the depletion of the mineral value. A method for achieving this result by increasing the residence time of the leach solution in the formation is also disclosed.

4 Claims, No Drawings

IN SITU LEACHING PROCESS

FIELD OF THE INVENTION

This invention relates to the recovery of mineral values, particularly uranium, by the in situ leaching of subterranean formations.

BACKGROUND OF THE INVENTION

In conventional in situ leaching processes a lixiviant, also called a leach solution, is pumped into a mineral-bearing formation through an injection well, and a pregnant lixiviant, or leachate, containing the mineral value is removed from the formation through one or more production wells. This method is especially valuable in the recovery of uranium, as discussed in R. W. Merritt, *The Extractive Metallurgy of Uranium* 108–112 (1971).

When in situ leaching is practiced in the field, it is observed that the leachability of uranium ores varies significantly among ore bodies, regardless of the lixiviant system used. The reasons for these variations are not known. The complexity of the problem is aggravated by the wide variety of ore body mineralogy and geology, as well as by the variety of leaching systems currently available. Some of the solutions proposed involve the use of more powerful oxidants or heat to increase leaching rates, but these approaches tend not only to increase process costs but also to introduce new environmental and process difficulties that familiar leaching systems such as $CO_2/O_2$ do not pose.

In typical practice, the pumping rate, and thus the residence time of the lixiviant in the formation, is maintained at a constant level throughout the entire period of the leaching operation. As a result, the concentration of uranium in the leachate decreases continuously as the uranium in the ore body is depleted, causing a reduction in production of yellowcake and increased costs per pound of useable uranium.

SUMMARY AND DESCRIPTION OF THE INVENTION

I have invented a method by which the uranium concentration in the leachate may be kept relatively high and constant without reducing the daily uranium production rate. The increased uranium concentration in the leachate, and thus the reduced volume of leachate for surface processing, improves the overall efficiency of the operation, by minimizing uranium leakage, by reducing pumping and well-maintenance costs, and by lowering the resin and operation costs, for example.

Most of the in situ uranium leaching processes using $CO_2/O_2$ are limited by the reaction rate, even where ore leachability is relatively high. In such a system it has been found that the leachate uranium concentration $[U_S]_L$ may be expressed in terms of fraction of uranium recovery:

$$[U_S]_L=[U_R]_O(1-\eta)\kappa L(1/u), \quad (1)$$

wherein $\kappa$ is first order rate constant, day$^{-1}$,

L is path length or well spacing, feet u is linear velocity of lixiviant, ft/hr $[U_R]_O$ is initial concentration of uranium in the ore, lb/pore volume $[U_S]$ is concentration of uranium in pregnant lixiviant, lb/pore volume $\eta$ is fraction of uranium already recovered from the ore as compared to the original uranium content.

Similary, the daily production rate P may be expressed:

$$P=[U_R]_O(1-\eta)\kappa L. \quad (2)$$

In accordance with this invention, daily production P may be kept relatively high and constant by reducing the pumping rate proportionally with the rate of uranium depletion. Equation (2) above indicates that while daily production P depends upon the uranium resource remaining $[U_R]_O(1-\eta)$, the rate constant $\kappa$ and path length L, P is independent from the pumping rate. Of course, the pumping rate must exceed the minimum critical value necessary to supply adequate lixiviant to the formation, but I have found that no advantages are achieved by pumping at above this critical rate. Increased pumping only decreases the uranium concentration in the pregnant lixiviant without increasing the daily production rate. Therefore, in order to maximize the concentration of uranium in the pregnant lixiviant, the pumping rate in accordance with this invention is kept at all times at or slightly above the critical value, which decreases proportionally to uranium depletion.

I have further applied the principles of this invention to overcome the uneconomically slow leaching rates of certain refractory ores. This may be done by increasing the residence time of the lixiviant in the refractory formation to from 0.2 to 5 times, preferably 1 to 2 times, the reciprocal of the first order rate constant $\kappa$ as set forth in Equations (1) and (2) above. The value of $\kappa$, and thus of its reciprocal, may be calculated by the substitution of observed values for the variables of Equations (1) and (2). To increase the residence time, the pumping rate of the lixiviant may be decreased for a given fixed well pattern, or the well spacing may be increased while maintaining the pumping rate. The latter is preferred for reasons of economy and will result in well spacings as wide as 300–400 feet in some ores, which is much wider than conventional patterns.

The foregoing description of my invention has been directed to particular details in accordance with the requirements of the Patent Act and for purposes of explanation and illustration. It will be apparent, however, to those skilled in this art that many modifications and changes may be made without departing from the scope and spirit of the invention. It is further apparent that persons of ordinary skill in this art will, on the basis of this disclosure, be able to practice the invention within a broad range of process conditions. It is my intention in the following claims to cover all such equivalent modifications and variations as fall within the true scope and spirit of my invention.

What is claimed is:

1. In the process for in situ leaching of mineral values from a mineral-bearing subterranean formation comprising the pumping of a suitable lixiviant into the formation through one or more injection wells under pressure, allowing the lixiviant to leach out the mineral values in the formation, and removing the lixiviant pregnant with mineral values from said formation through one or more production wells spaced from said injection wells, the improvement which comprises:

regulating the rate at which the lixiviant is pumped into the formation so that the pumping rate remains at or slightly above the minimum pumping rate necessary to supply adequate lixiviant to the formation and concurrently decreasing the pumping rate proportionally to the depletion of the mineral value in said formation.

2. The process of claim 1, wherein the mineral value is uranium.

3. The process of claim 2, further comprising adjusting the pumping rate or the spacing of said injection and production wells such that the residence time is between about 0.2 and 5 times the reciprocal of the first order rate constant for the particular formation and particular lixiviant, as defined by the formula $$[U_S]=[U_R]_O(1-\eta)\kappa L(1/u),$$

wherein L is the path length or well spacing in feet, u is the linear velocity of the lixiviant in feet per hour, $\kappa$ is the first order rate constant in day$^{-1}$, $[U_R]_O$ is the initial concentration of uranium in the formation in lb/pore volume, $[U_S]$ is the concentration of uranium in the pregnant lixiviant in lb/pore volume and $\eta$ is the fraction of uranium recovered in the ore as a proportion of the initial uranium content of the formation.

4. The process of claim 2, wherein said residence time is between about 1 and 2 times the reciprocal of the first order rate constant.

* * * * *